US005230494A

United States Patent [19]

Adams

[11] Patent Number: 5,230,494

[45] Date of Patent: Jul. 27, 1993

[54] MOUNTING BRACKET FOR WINDOW TREATMENTS

[75] Inventor: William E. Adams, Portersville, Pa.

[73] Assignee: Adams Mfg. Co., Portersville, Pa.

[21] Appl. No.: 892,955

[22] Filed: Jun. 3, 1992

[51] Int. Cl.[5] ..... A47H 1/10

[52] U.S. Cl. ..... 248/266; 248/205.5; 160/903

[58] Field of Search ..... 248/205.5, 252, 254, 248/262, 264, 266, 267, 268; 160/370.2, 23.1, 903

[56] References Cited

U.S. PATENT DOCUMENTS

| | | | |
|---|---|---|---|
| 253,392 | 2/1882 | Middleton . | |
| 722,387 | 3/1903 | Scott . | |
| 1,182,804 | 5/1916 | Schultz | 248/254 |
| 1,218,774 | 3/1917 | Hoover | 248/254 |
| 1,425,052 | 8/1922 | Rejsa | 248/267 |
| 1,458,232 | 6/1923 | Maienschein . | |
| 1,525,895 | 2/1925 | Sherwood . | |
| 1,595,987 | 8/1926 | Bennett . | |
| 1,733,246 | 10/1929 | Summerhayes, Jr. . | |
| 2,233,430 | 3/1941 | Ratcliffe | 248/254 |
| 2,315,566 | 4/1943 | Watral et al. | 211/123 |
| 2,452,680 | 11/1948 | Ratciffe | 248/254 |
| 2,596,054 | 5/1952 | Tallman | 211/87 |
| 2,703,693 | 3/1955 | Cropanese | 248/264 X |
| 2,764,382 | 9/1956 | Gubernick | 248/206 |
| 2,770,437 | 11/1956 | Pasch | 248/262 |
| 4,428,412 | 1/1984 | Toro | 160/23.1 |
| 4,607,875 | 8/1986 | McGirr | 296/97 |
| 4,696,447 | 8/1987 | Strecker | 248/206 |
| 4,736,980 | 4/1988 | Eubanks | 160/370.2 X |
| 4,951,909 | 8/1990 | Russo | 248/206 |
| 5,011,030 | 4/1991 | Alaurent | 248/264 X |

FOREIGN PATENT DOCUMENTS 214450 8/1967 Sweden .

*Primary Examiner*—David M. Purol

*Attorney, Agent, or Firm*—Buchanan Ingersoll; Lynn J. Alstadt

[57] ABSTRACT

A pair of mounting brackets are disclosed which are readily removably but securely attach to any window for purposes of mounting a variety of window treatments in an aesthetic manner. The mounting brackets are attached to the window by a plurality of suction cups. Each bracket is comprised of a base plate and an elongated mounting element oriented substantially perpendicular to the base plate. The mounting element is adapted to receive one of a shade and a curtain rod substantially above the window and outside of the periphery of the window. When in a closed position the window treatment blocks any significant light or air draft from being transmitted from the exterior of the building to the interior of the building. A connecting portion having a configuration which conforms to the window frame is provided between the base plate and the mounting element.

15 Claims, 2 Drawing Sheets

MOUNTING BRACKET FOR WINDOW TREATMENTS

BACKGROUND OF THE INVENTION

1. Field of Invention

This disclosure relates primarily to a mounting bracket means for positioning window treatments above a window. More particularly this disclosure relates to a mounting bracket means for window treatments which is mounted or secured to the window by suction cups and is able to be positioned to optimize the insulation, privacy and shielding effect of the window treatment.

2. Description of Prior Art

Window treatments such as shades, blinds or curtains are necessarily hung from brackets which are either permanently affixed (by screws, bolts, etc.) or temporarily affixed (by tape, suction cups, etc.) to an adjacent wall or window frame surrounding the windows to be covered. If such mounting brackets are affixed by bolts or screws, damage is caused to the wall or window frame, which upon removal of the window treatment, the wall, or window frame must be repaired.

The readily removable mounting brackets of the prior art typically are not constructed to securely hold any window treatment for any long-term use. These temporary brackets also are not constructed to prevent lateral movement of the shade or of the mounting brackets. All known readily removable mounting brackets permit slight lateral movement which allows one of the pair of bracketed mounting means to move sideways causing the shade or curtain to fall.

In light of our mobile society and transient population, a need exists for a mounting means for window coverings which may be easily removed, easily installed and adaptable to a variety of shapes and sizes of windows for use in both commercial and residential buildings. Such a device would permit continual change and variation of window treatments without the problems associated with traditional bracket mounting installations. A mounting bracket which is easily installed and removed may be used repeatedly in different locations, thereby eliminating the cost of new hardware for the installation of new window treatments at any location or upon any relocation of window treatments.

Although temporary mounting brackets have been devised for quick installation and removal, these prior art attempts are not aesthetically pleasing. Some prior art devices have bracketed elements together with suction cup assemblies which are in full view after placement of the blind or shade thereon.

There is therefore a need for a temporary mounting means which will secure window treatments as securely as the permanent mounting means, but which is also aesthetically pleasing having a substantial portion of the bracketed mounting elements being hidden from full view by the window treatment.

If properly fitted against a window, window treatments may serve to insulate, as well as provide privacy and achieve shielding of light. When correctly sized and fitted against the window, the window treatment will impede drafts of incoming air and prevent warmed air from falling over a cold window, causing drafts and higher heating bills. The prior art mounting devices are not shaped to hold window treatments sufficiently close to window frames to impede air flow. Rather they create gaps near the edges of the window treatment. This is energy wasting. Therefore, any mounting bracket for window treatments should allow installation of shades or curtains easily and quickly so that millions of otherwise uninsulated windows may be easily covered. The use of such a device would positively affect energy conservation and benefit all consumers and reduce the nation's energy consumption by a significant amount.

SUMMARY OF THE INVENTION

I provide a mounting system for mounting shades and curtains securely with respect to a window frame by means of a plurality of suction cups. These suction cups, fitted securely into apertures contained in a base plate, serve to affix the bracket more securely with respect to the window. Connecting the mounting bracket by the suction cups allows for the mounting system to not only be adaptable to the standard windows, but the mounting bracket will also work with odd sized windows and frames. The adjustable positioning of the suction cups allows for the window treatment to be positioned close to the window edge or overlapping the window and/or window frames periphery thus, preventing drafts from moving from the exterior of the building to the interior of the building Further, the plurality of suction cups are positioned in a nonaligned configuration with respect to one another and attached to the base plate in order to stabilize the mounting bracket and offset any countervailing variables such as dirt, scratches or imperfections in or on the glass surface that may cause one cup to detach from the window.

My bracket has an elongated mounting element which is oriented substantially perpendicular to the base plate and outward of the periphery of the window and/or frame such that it is able to receive one of a shade and/or a curtain rod substantially above the window and/or window frame. By positioning the mounting bracket outside of the periphery of the window and/or frame, the window treatment mounted on the mounting bracket also extends outside of the periphery of the window and/or window frame. Thus, the window treatment will overlap the whole periphery of the window if the shade is drawn to a closed position. The portion of the window treatment which extends outward of the periphery of the window frame prevents light or drafts from entering the building through the windows. Further, by mounting the window treatment to extend outside of the periphery of the window frame, privacy is also increased.

A connecting means secures the base plate to the elongated mounting element. Preferably, this connecting means includes a first and second portion and is generally configured to correspond to the shape of the window frame with which it is to be employed so as to achieve increased shielding effect, increased privacy protection and increased thermal insulation. The connecting means in conjunction with the adjustability of the placement of the mounting brackets via the plurality of suction cups which allows for the window treatment to be placed close to the window frame further increases the shielding, privacy and insulation characteristics.

Because of the coordination of the base plate, connecting means and mounting element, the mounting bracket provides a more secure apparatus to guard against lateral movement.

My bracket can be easily and efficiently mounted and dismounted on any window no matter the size or shape of the window and the bracket will accommodate a variety of window treatments.

Window treatments so mounted allow millions of people to easily provide themselves with better insulated windows, reducing energy use for all heated or air-conditioned spaces with windows.

BRIEF DESCRIPTION OF THE DRAWINGS

Other details, objects and advantages of the invention will become apparent by the following description of preferred and alternative, but nonetheless illustrative, embodiments of my mounting bracket with reference to the accompanying drawings, wherein.

DESCRIPTION OF THE PREFERRED EMBODIMENT

Figure 1:
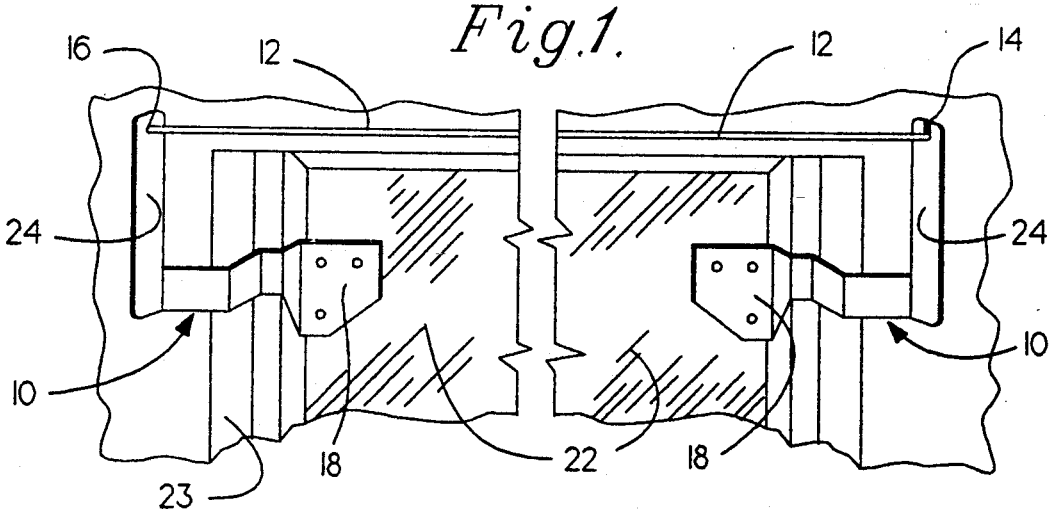
FIG. 1 is a front elevational view partially cut away of a window having a pair of my first present preferred brackets affixed thereto and carrying a curtain rod.
Figure 2:
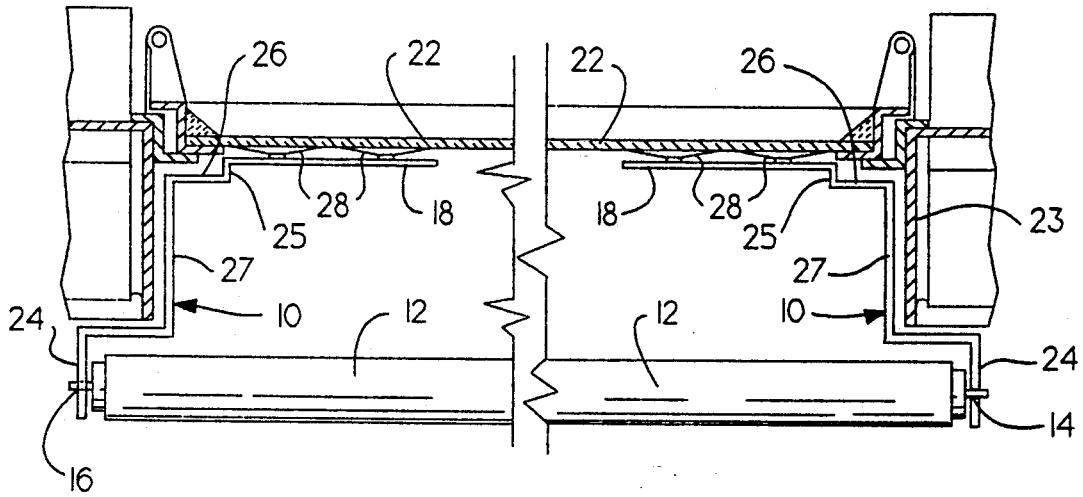
FIG. 2 is a horizontal transverse sectional view of a steel casement window having a pair of my first present preferred brackets affixed thereto and supporting a roller shade.
Figure 4:
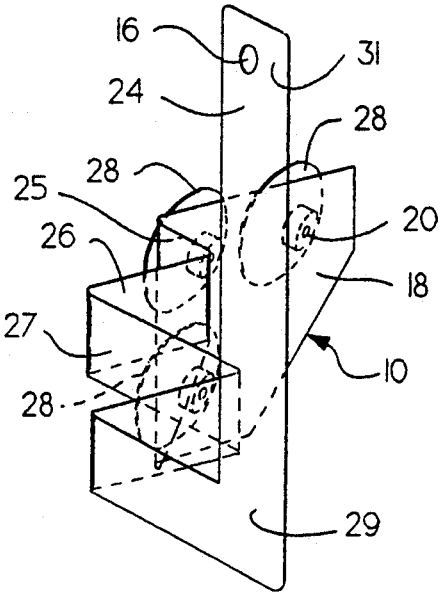
FIG. 4 is a perspective view of the first present preferred embodiment of my bracket.

Referring now to FIGS. 1, 2 and 4, there is illustrated my first present preferred mounting bracket for a shade or curtain rod, generally designated 10, to be used for a variety of sizes and shapes of windows and window frames. The shade or curtain rod 12 shown in FIGS. 1 and 2 is one of the traditional rods or shades used in window treatments which may have hardware protruding from an end which fits into a slot assembly 14 or a cylindrical pin which fits through an aperture 16 in the mounting bracket 10. Other types of rods or shades could also be hung with little or no modification to the bracket.

Figure 3:
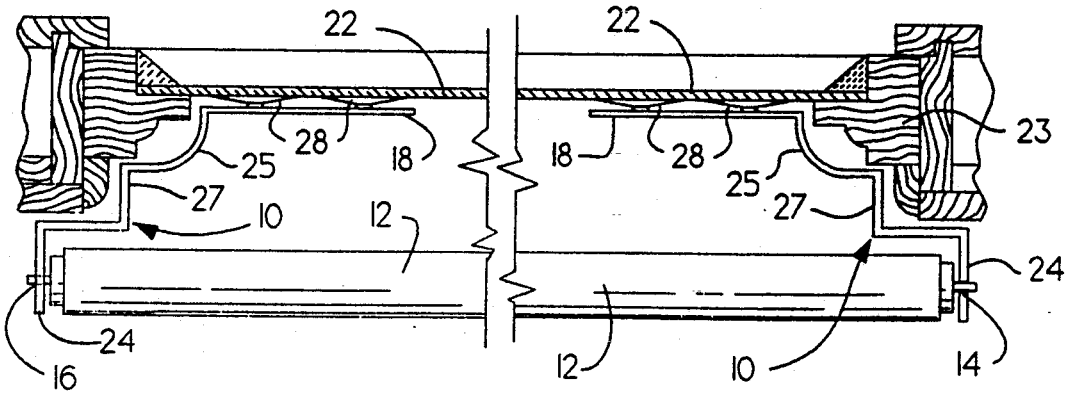
FIG. 3 is a horizontal transverse sectional view of a wood sash window having a pair of my second present preferred brackets affixed thereto and supporting a roller shade.

The mounting bracket 10 comprises a base plate 18 having a plurality of apertures 20 to be fitted with a plurality of suction cups 28. The base plate serves to attach the mounting bracket 10 to the window 22 (as illustrated in FIGS. 1–3) by means of the suction cups 28 which engage and stick to the window 22. Although the suction cups shown in the figures have a circular base one could also use oblong suction cups of the type disclosed in my U.S. Pat. No. 5,078,356. The mounting bracket 10 also comprises an elongated mounting element 24 having a first end 29 and a second end 31. The mounting element is oriented substantially perpendicular to the base plate 18 and adapted to receive one of a shade and curtain rod 12 at the second end 31 of the mounting element 24 which extends above the window 22. A triangular piece (not shown) could be added to the top end 31 to fit within a slot in a channel shaped curtain rod (not shown). A connecting means 26 is attached between the mounting element 24 and the base plate 18. The connecting means 26, as illustrated, includes a first portion 25 and a second portion 27 of a shape adapted to fit around a window frame 23 in close proximity and extend horizontally outward of the window 22 and frame 23. The mounting element 24 is attached to the second portion 27 of the connecting means. The elongated mounting element 24 extends vertically from the second portion 27 of the connecting means 26 above the window. The second end 31 of the mounting element 24 can include either an aperture 16 for a pin of a shade to extend into or a slot 14 for a curtain rod to be received therein. Both the first portion 25 and the second portion 27 of the connecting means 26 are L-shaped and connected to one another thereby fitting around and in close proximity to a traditional window frame 23.

Figure 5:
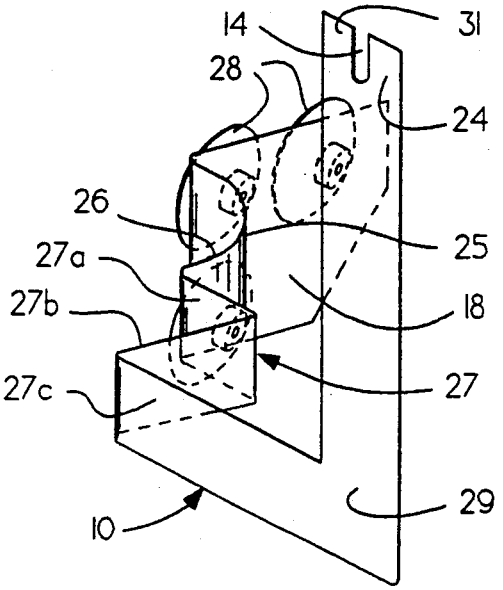
FIG. 5 is a perspective view of the second present preferred embodiment of my bracket.

My second present preferred bracket can be seen in FIGS. 3 and 5. This embodiment has the same base plate 18 and elongated mounting element 24. However, the first portion 25 of the connecting means 26 is curved to fit securely around a curved window frame and the second portion 27 of the connecting means 26 is L-shaped in order that the elongated mounting element 24 extend outward and horizontal with respect to the window frame. The first portion 25 is connected to the second portion 27 of the connecting means 26. In this embodiment second portion 27 is comprised of segments **27*a*, 27*b* and 27*c*. Mounting element 24 extends from segment 27*c*. However, one could eliminate segments 27*b* and 27*c*, extend segment 27*a* and attach mounting element 24 to segment 27*a***.

The connecting means 26 provides for the mounting element 24 to extend outwardly of the periphery of the window such that the window treatment is positioned substantially above the window 22 and/or frame 23, as seen in FIGS. 1–3.

The positioning of the mounting element outward of the periphery of the window and frame allows a shade or curtain hung therefrom to completely cover the window when in a closed position. When closed the shade or curtain prevents any significant amount of light and/or air from passing from the exterior of the building to the interior of the building along the periphery of the window thus, increasing the thermal insulating effects, the light shielding effects and the privacy protection of the window treatment.

Suction cups 28 are fitted into the apertures 20 located in the base plate 18. These suction cups may be easily removed by merely pressing against the cylindrical end 30 of the cup 28 through the aperture 20. The adjustability of the position of the mounting element allows the suction cups to be placed anywhere on the window which results in the window treatment being positioned in the optimum location for privacy, insulation and light shielding purposes. The plurality of suction cups are in a nonaligned position with respect to one another. A preferred embodiment is to position three (3) suction cups in a triangular configuration as generally seen in the perspective views of FIGS. 4 and 5. The application of the suction cups 28 to the window 22 serves to create a vacuum which causes the base plate 18 of the mounting bracket 10 to adhere to the window. It is important that the mounting bracket be attached such that the mounting bracket can not move horizontally which would allow the shade or curtain rod to fall out. It is also important that the bracket can not move vertically to any degree, in order that the shade or curtain rod is held perfectly horizontal, even if a heavy curtain is pulled to one side of the window. The triangular shape of the suction cup placement solves both of these problems. However, four smaller suction cups positioned in a square configuration would also work to solve the problems of lateral and vertical movement. Further, an array of more than four small cups could also be used and that arrangement may make removal easier.

When the triangular configuration of the suction cups is utilized to affix the mounting element to the window, the size of the suction cups vary with the width of the window treatment. It is suggested to utilize ¾ inch diameter suction cups with window treatments having a width of less than 18 inches. Suction cups having a 1⅛ inches diameter are suggested when the window treatment has a width of between 18 to 36 inches and suction cups having a diameter of 2½ inches are suggested when a window treatment with a width of greater than 36 inches is mounted on the window. The suction cups need not all be the same diameter. It may be preferable to use smaller suction cups in the two holes nearest connecting means 26 so that the rim of these suction cups does not extend beyond base plate 18. Then the edge of base plate 18 which is joined to connecting means 26 will fit snugly against a window frame.

Figure 6:
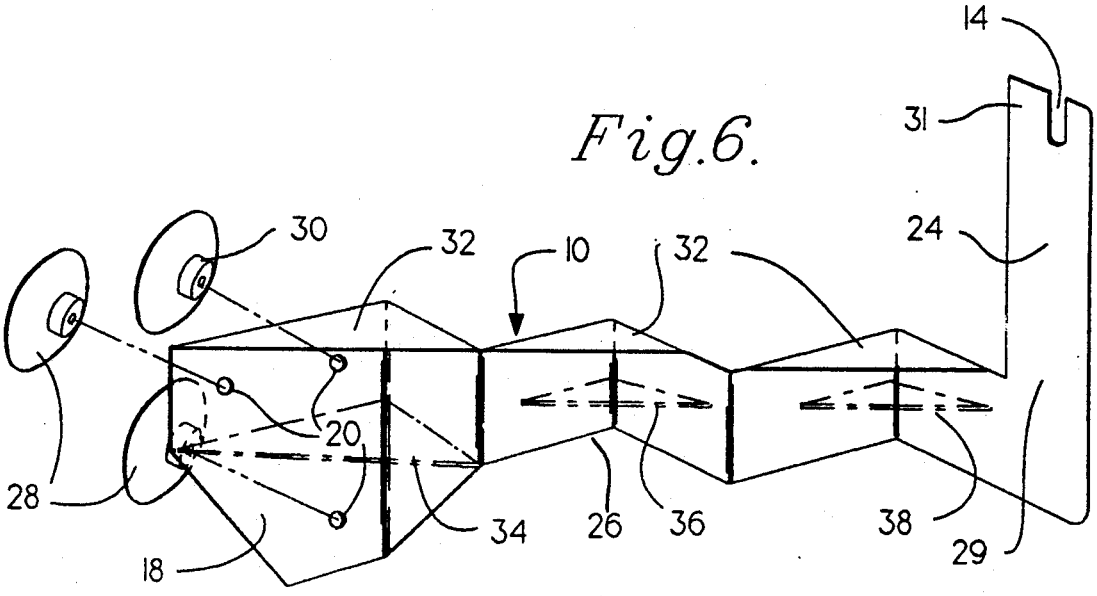
FIG. 6 is a third present preferred embodiment of my bracket in which gussets are provided to increase rigidity.

As shown in FIG. 6, a gusset 34 may be attached to the pivotal juncture, located between the base plate 18 and the first portion 25 of the connecting means 26 in order to provide a stronger more rigid mounting bracket. An additional gusset 36 may be attached to the pivotal juncture located between the first portion 25 and the second portion 27 of the connecting means 26 and another gusset 38 may be attached between the second portion 27 of the connecting means and the elongated mounting element 24. The corner braces 32 located in a parallel position to the gussets 34, 36, and 38 also serves to create a stronger and more rigid mounting bracket.

The bracket may be made of metal, plastic or other suitable material. The selected material should be capable of withstanding any temperature variations resulting from a change in outdoor temperatures. I prefer to make the bracket of a transparent, plastic material such as polycarbonate because of its durability, strength and stiffness and its resistance to discoloration from constant light exposure.

Preferably, the bracket is molded as one piece. However, the optional gussets and corner braces may be separate pieces which are glued or welded in place.

While the principals of the invention have now been made clear in an illustrative embodiment, there will be immediately obvious to those skilled in the art, many modifications of structure, arrangement, components and materials used in the practice of the invention which are particularly adapted for specific environments and structural configurations without departing from those principals.

I claim:

1. A mounting bracket for mounting shades and curtains to window glass comprising:

(a) a base plate having a plurality of apertures;

(b) a suction cup fitted securely into each of the plurality of apertures;

(c) an elongated mounting element oriented substantially perpendicular to the base plate and sized to extend in a vertical direction above a window, such that the mounting element is adapted to receive one of a shade and a curtain rod positioned substantially above the window; and (d) a connecting means attached between the base plate and the mounting element, the connecting means having a first portion and a second portion of a shape adapted to fit horizontally around a window frame for positioning the mounting element outward of the periphery of the window frame.

2. The mounting bracket of claim 1 also comprising a first corner brace attached and oriented substantially perpendicular to the first portion of the connecting means and the base plate.

3. The mounting bracket of claim 2 also comprising a second corner brace attached and oriented substantially perpendicular to the first and second portions of the connecting means, and a third corner brace attached and oriented substantially perpendicular to the second portion of the connecting means and the mounting element.

4. The mounting bracket of claim 1 wherein the base plate has three apertures that are not aligned relative to one another.

5. The mounting bracket of claim 1 wherein the suction cups are removable from the base plate.

6. The mounting bracket of claim 1 wherein the first and second portions of the connecting means are L-shaped and configured such that, the connecting means fits around a window frame in close proximity for the purpose of insulation, privacy and shielding of light.

7. The mounting bracket of claim 1 wherein the first portion of the connecting means is curved and the second portion of the connecting means is L-shaped so that the connecting means may fit around a generally curved window frame in close proximity for the purpose of insulation, privacy and shielding of light.

8. The mounting bracket of claim 1 wherein the base plate, the mounting element and the connecting means are made of a transparent plastic.

9. The mounting bracket of claim 1 wherein the mounting element and the second portion of the connecting means are secured by means of a gusset oriented substantially perpendicular to the second portion of the connecting means and the mounting element.

10. The mounting bracket of claim 1 wherein the first portion of the connecting means and the base plate are secured by means of a gusset oriented substantially perpendicular to the first portion of the connecting means and the base plate.

11. The mounting bracket of claim 1, wherein the base plate, the mounting element and the connecting means are made from a material resistant to discoloration from prolonged light exposure and capable of withstanding temperature variations which occur at a window surface.

12. The mounting bracket of claim 11 wherein the material is polycarbonate.

13. The mounting bracket of claim 1, wherein the suction cups are positioned in a triangular configuration in order to resist downward movement of the shade held by the mounting bracket when the shade is pulled.

14. The mounting bracket of claim 1 wherein the first and second portions of the connecting means are secured by means of a gusset oriented substantially perpendicular to the first and second portions of the connecting means.

15. A mounting system for hanging window treatments above a window having a window frame comprising two mounting brackets each of said two mounting brackets comprised of:

(a) a base plate having a plurality of apertures;

(b) a suction cup fitted securely into each of the plurality of apertures;

(c) an elongated mounting element having a first and second end, the mounting element oriented substantially perpendicular to the base plate; and (d) a connecting means attached between the base plate and the mounting element, the connecting means having a shape adapted to fit around a window frame for positioning the mounting element outward of the periphery of the window frame such that the first end of the mounting element is attached to the connecting means and the second end of the mounting element extends above and outward of the window frame in order that the second end of the mounting element can receive one of a shade and a curtain rod above the window frame thereby allowing at least one of a shade and a curtain to completely cover the window.

* * * * *